US005579799A

United States Patent [19]

Zheng

[11] Patent Number: 5,579,799

[45] **Date of Patent: *Dec. 3, 1996**

[54] COLLAPSIBLE SHADE STRUCTURE

[76] Inventor: Yu Zheng, 1065 Howard Ave., Covina, Calif. 91722

[ * ] Notice: The term of this patent shall not extend beyond the expiration date of Pat. No. 5,301,705.

[21] Appl. No.: 529,552

[22] Filed: Sep. 18, 1995

Related U.S. Application Data

[63] Continuation of Ser. No. 24,690, Mar. 1, 1993, Pat. No. 5,467,794, which is a continuation-in-part of Ser. No. 764, 784, Sep. 24, 1991, Pat. No. 5,301,705.

[51] Int. Cl.[6] ..... E04H 15/40

[52] U.S. Cl. ..... 135/126; 135/130; 135/137; 135/117

[58] Field of Search ..... 135/124, 125, 135/126, 127, 128, 137, 97, 114, 115, 116, 117

[56] References Cited

U.S. PATENT DOCUMENTS 4,165,757 8/1979 Marks .
4,265,261 5/1981 Barker .
4,825,892 5/1989 Norman .
5,038,812 8/1991 Norman .
5,137,044 8/1992 Brady .

*Primary Examiner*—Lanna Mai
*Attorney, Agent, or Firm*—Raymond Sun

[57] ABSTRACT

A collapsible shade structure includes a plurality of foldable frame members each having a folded and an unfolded orientation. A fabric material is provided for substantially covering the frame members to form a side panel for each frame member, each side panel assuming the unfolded orientation of its associated frame member. Interconnecting portions of the fabric material form a hinge portion between each frame member. Alternatively, frame retaining sleeve portions may be used to interconnect and retain two or more frame members from two or more adjacent side panels and to act as hinge portions. The structure may be folded and stored by folding the side panels and their corresponding frame members on top of each other about the hinge portions to have the side panels and frame members overlying each other. The overlaying side panels and frame members are then collapsed by twisting and folding to form a plurality of concentric frame members and side panels to substantially reduce the size of the shade structure.

15 Claims, 15 Drawing Sheets

FIG. 6A
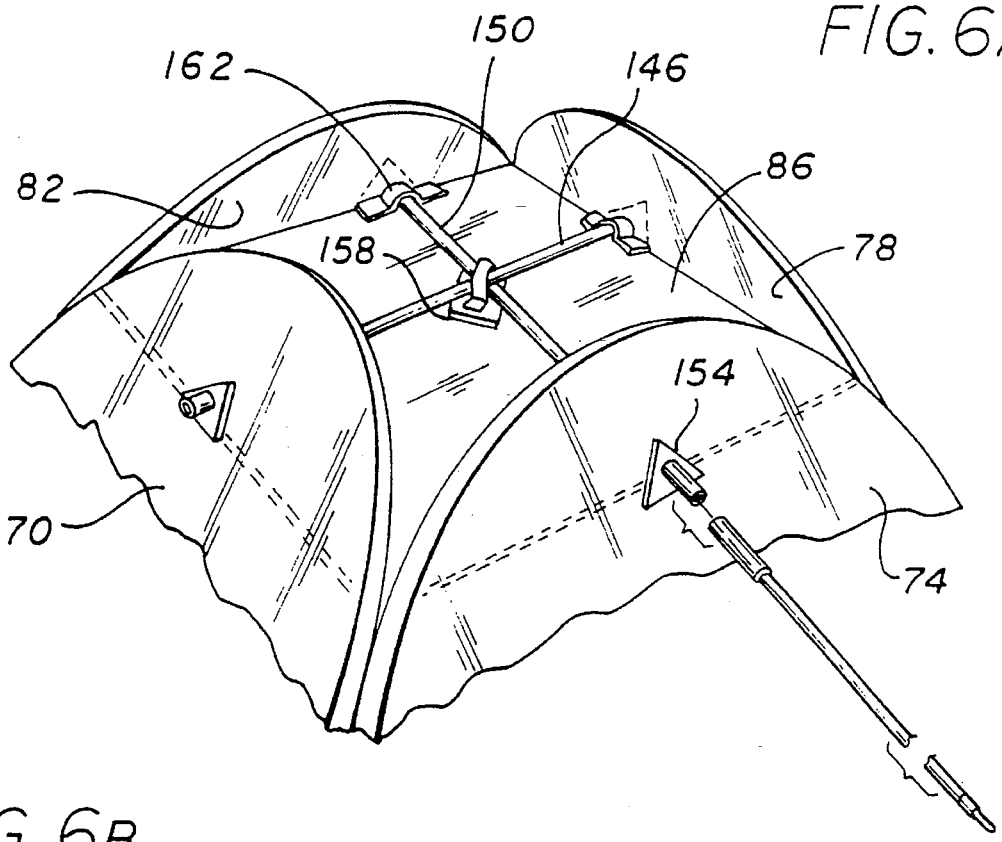
FIG. 6B
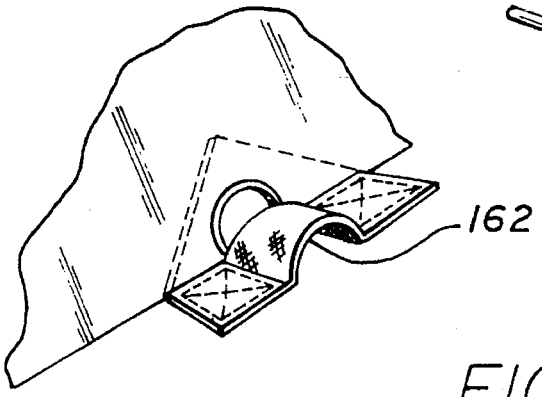
FIG. 6C
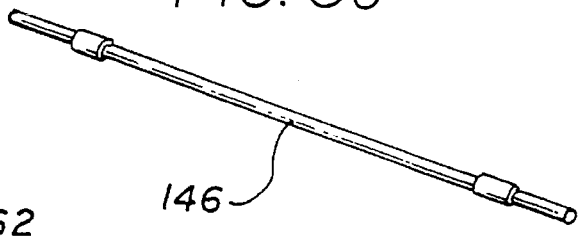
FIG. 6D
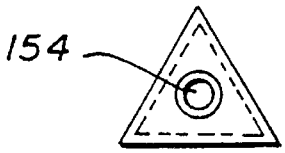
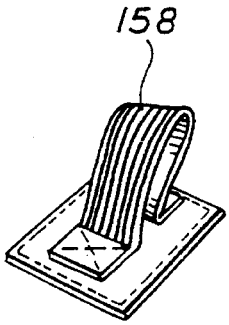
FIG. 6E
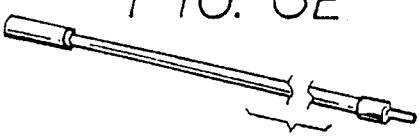
FIG. 6F FIG. 7
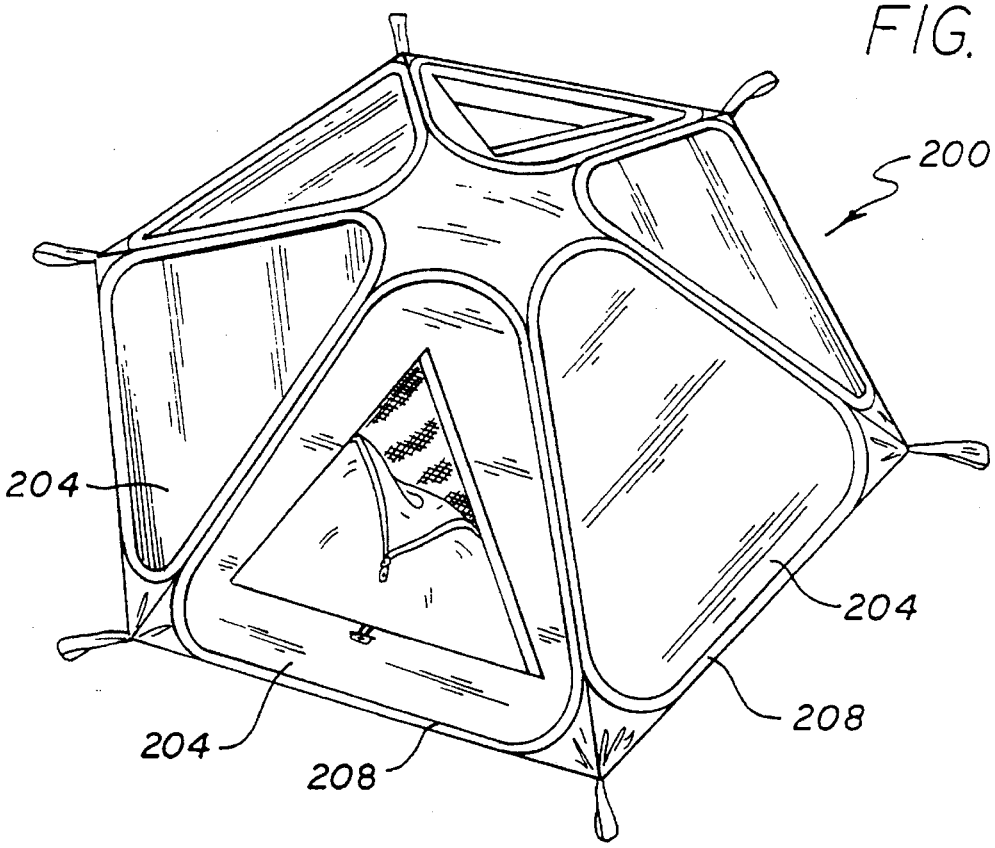
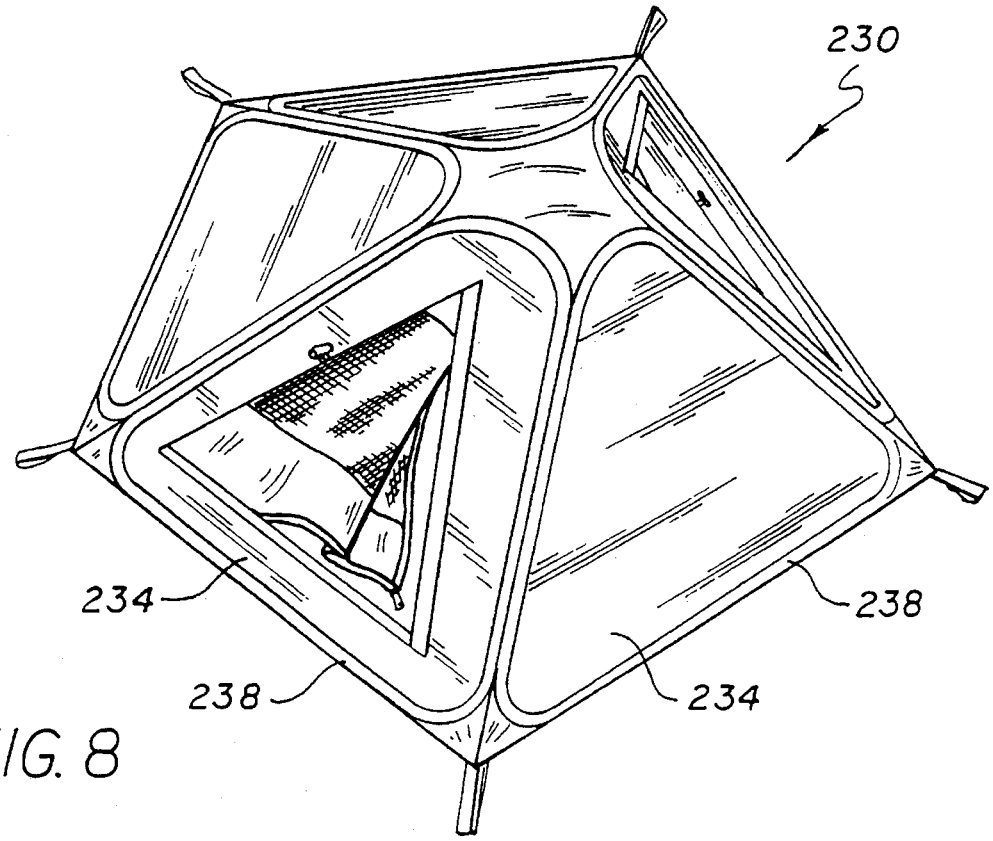
FIG. 8

FIG. 11(E)
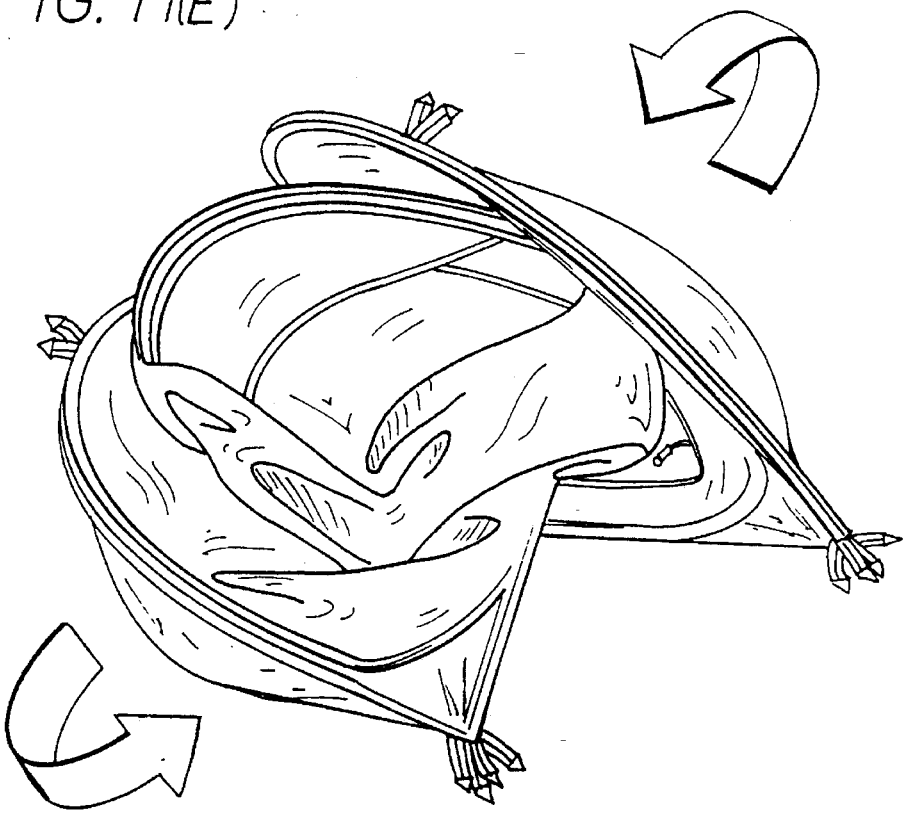
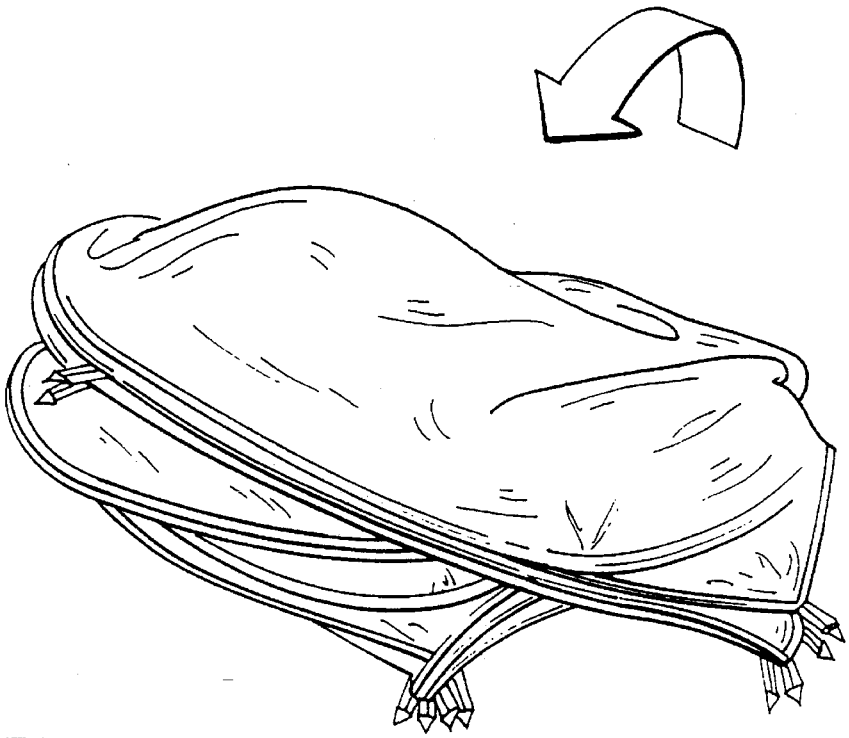
FIG. 11(F)

COLLAPSIBLE SHADE STRUCTURE

RELATED CASE

This is a continuation of application Ser. No. 08/024,690, filed on Mar. 1, 1993, now U.S. Pat. No. 5,467,794, which is a continuation-in-part of Ser. No. 07/764,784, filed Sep. 24, 1991, entitled "Collapsible Shade Structure", now U.S. Pat. No. 5,301,705.

BACKGROUND OF THE INVENTION

1. Field of the Invention

The present invention relates to collapsible shade structures and specifically to collapsible or folding tents. The shade structure of the present invention provides an integral structure capable of supporting itself to act as a shelter.

2. Description of the Prior Art

Prior art collapsible shade structures have suffered from several drawbacks. One drawback with such collapsible shade structures is the difficulty associated with erecting and stably supporting such structures. Another drawback associated with these prior art collapsible shade structures is that the construction of such structures tends to be complicated and bulky. As a result, such structures are expensive to manufacture and are troublesome to fold away and to store.

A further drawback of such prior art collapsible shade structures is that the frame structure itself tends to be weak even after it has been erected, and often requires other means to provide the required structural integrity. Examples of such structures are disclosed in U.S. Pat. Nos. 3,990,463 and 3,960,161, both of which disclose collapsible shelters each having a flexible and coilable frame member secured to the fabric of the structure and held in a "figure-eight" configuration. Tie members secured to portions of the fabric are required to stabilize the frame and to hold the frame and the remainder of the structure upright because the frame member alone cannot accomplish this.

Another example is U.S. Pat. No. 5,038,812, which discloses a collapsible shelter-in which the frame members as configured cannot hold the side panels together because the side panels tend to stretch outwardly. Hence, a floor member or straps are required to hold the side panels together.

The various existing collapsible shade structures have not been successful in providing a simple structure which is inexpensive to manufacture, is easy to erect, and may be easily folded to a compact size, in which the structure when erected is capable of stably supporting itself. The present invention, therefore, provides for an improvement over the prior art collapsible shade structures and provides a collapsible shade structure with a novel frame structure in which the structure when erected is capable of stably supporting itself, and which also allows the collapsible shade structure to be of simple construction, to be easily erected and to be easily folded to a compact size. The present invention further includes improvements to the retention of the frame members which make the structure easier and less expensive to manufacture, and easier to operate.

SUMMARY OF THE DISCLOSURE

In order to accomplish the objects of the present invention, the collapsible shade structure is made of a plurality of foldable frame members each having a folded and an unfolded orientation. Three or more of such frame members are configured to form an interior space. A fabric material is provided which substantially comers the frame members to form a side panel for each frame member, each side panel assuming the unfolded orientation of its associated frame member. Interconnecting portions of the fabric material form a hinge portion between each frame member. A roof formed from the fabric material interconnects the upper portions of the side panels.

In one embodiment of the present invention, a separate retaining sleeve is provided for each frame member. In another embodiment, a retaining sleeve may be used to hold two or more frame members, so that interconnecting portions of the fabric are not needed to act as hinge portions. This retaining sleeve thereby acts as a hinge portion interconnecting adjacent side panels, which makes the structure easier to manufacture, and easier to fold and collapse.

When the structure is to be folded and stored, the side panels and their corresponding frame members may be folded on top of each other about the hinge portions to have the side panels and frame members overlaying each other. The overlying side panels and frame members are then collapsed by twisting and folding to form a plurality of concentric frame members and side panels to substantially reduce the size of the shade structure in the folded orientation.

The collapsible shade structure may be used as a shelter affording a camper, for example, the convenience of a tent which may be easily erected and-easily collapsed and folded to a compact arrangement that is a fraction of its unfolded size for easy storage. The materials used are lightweight, and together with its compact size, the tent is very convenient to transport.

BRIEF DESCRIPTION OF THE DRAWINGS

Further objects, advantages and features of the invention will become apparent from the detailed description of the preferred embodiments when read in conjunction with the accompanying drawings, in which:

FIG. 6 is a perspective view of a roof which may be used with the collapsible shade structure of FIG. 1;

FIG. 7 is a second embodiment of the collapsible shade structure having six side panels;

FIG. 8 is a third embodiment of the collapsible shade structure having five side panels;

FIGS. 11(A) through 11(F) illustrate the operation of the collapsible shade structure of FIG. 1 showing how it may be folded up for compact storage;

DETAILED DESCRIPTION OF THE PREFERRED EMBODIMENTS

The preferred embodiments of the present invention will be described in terms of tents with reference to FIGS. 1–17, although the principles and concepts are equally applicable to other collapsible shade structures. The scope of the invention is best defined by the appended claims.

Figure 1:
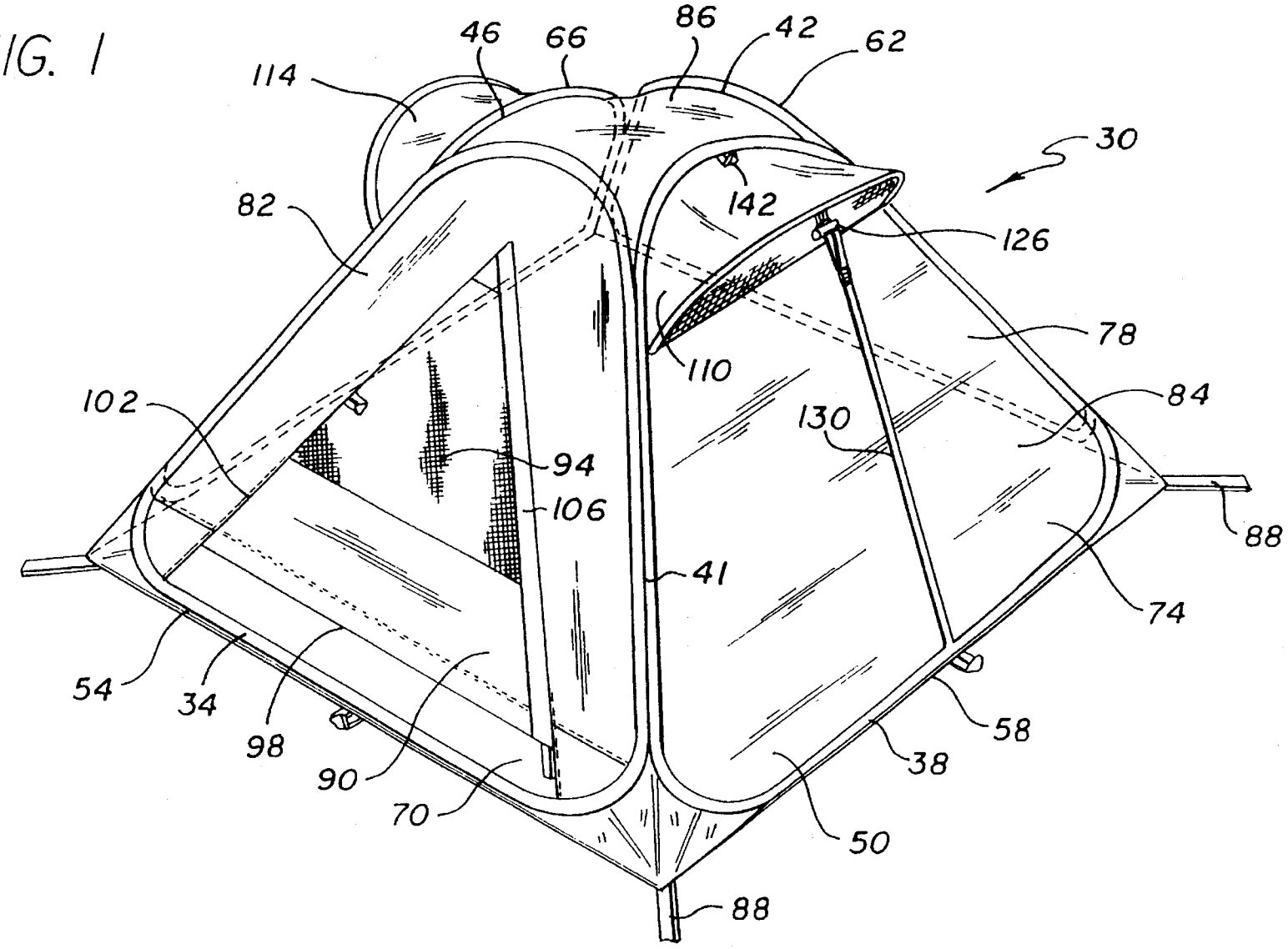
FIG. 1 is a perspective view of the collapsible shade structure having four triangular side panels.
Figure 2:
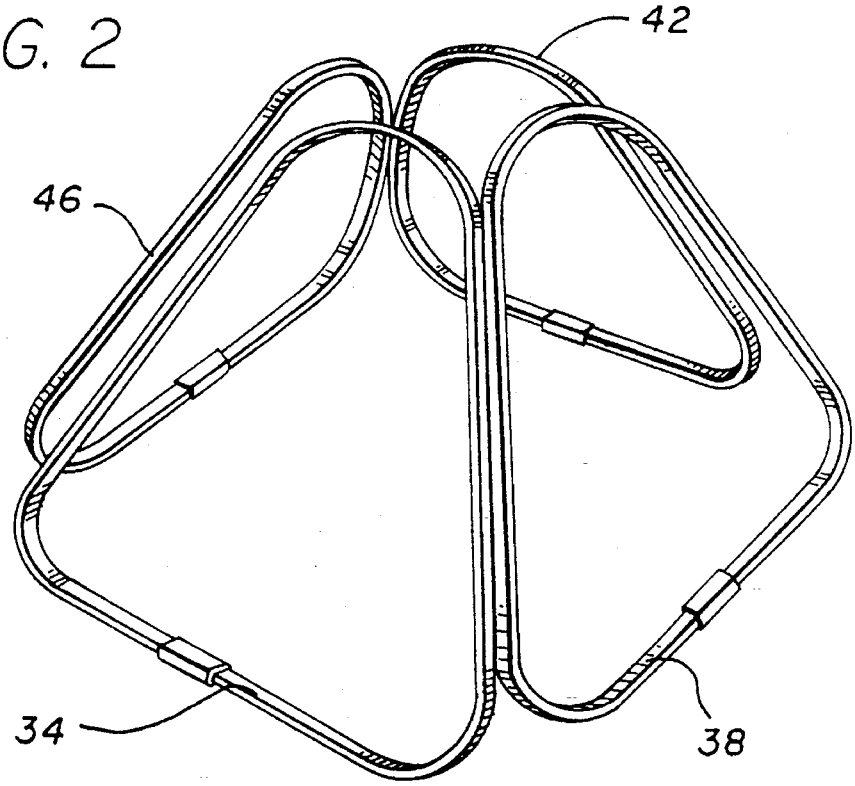
FIG. 2 is a perspective view of the internal frame structure of the collapsible shade structure of FIG. 1.
Figure 3:
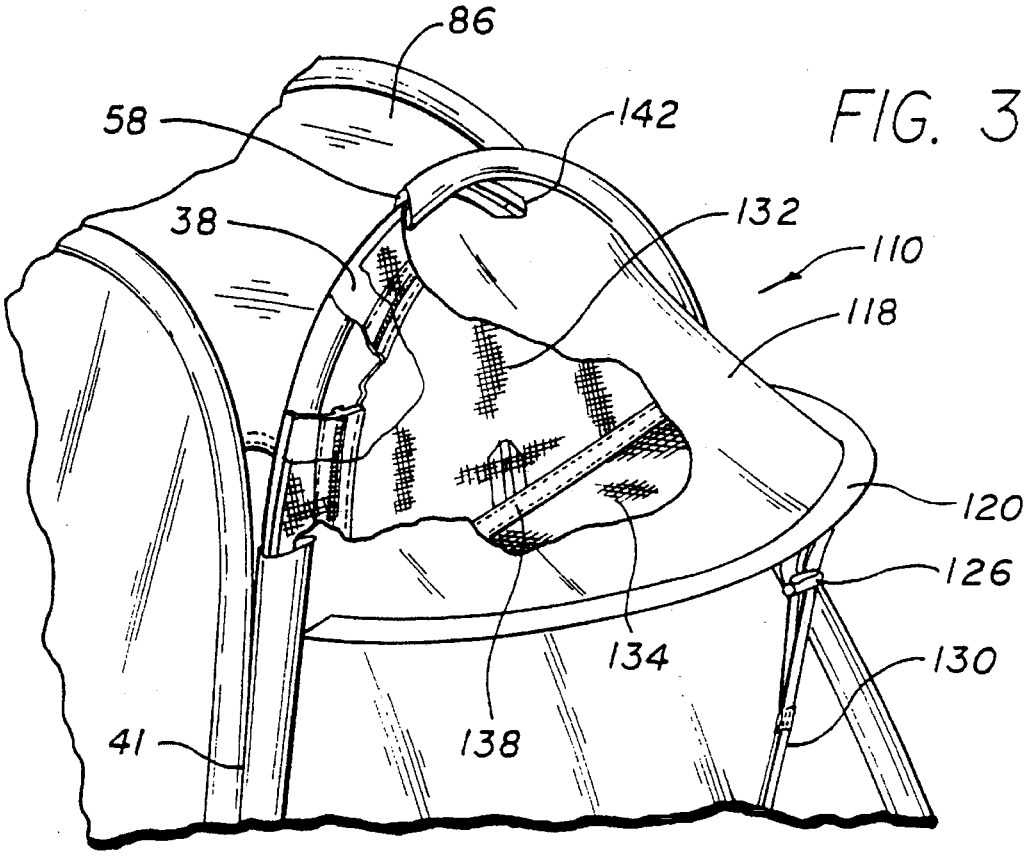
FIG. 3 is a perspective view partially broken away showing the vent of the collapsible shade structure of FIG. 1 in an open position.

As shown in FIGS. 1, 2 and 3, the basic structure for a tent 30 comprises four resilient frame members 34, 38, 42 and 46. While this basic structure is shown and described as having four frame members, it will be appreciated that three or more frame members may be used without departing from the spirit and scope of the present invention. Each of the frame members 34, 38, 42 and 46 has three sides connected by curved portions to form a triangular-shape. The frame members 34, 38, 42 and 46 are retained in position by fabric or sheet material 50, which includes retaining sleeves 54, 58, 62 and 66 for retaining the frame members 34, 38, 42 and 46, respectively. The retaining sleeves 54, 58, 62 and 66 may be mechanically fastened, stitched, fused, or glued to the frame members 34, 38, 42, and 46 to retain them in position. The fabric 50 in conjunction with the frame members 34, 38, 42, and 46 form four triangular side panels 70, 74, 78, and 82, respectively, so that each frame member is used to support one side panel. Each side panel and its associated frame member is vertically inclined inwardly at an angle and held together by hinged interconnecting portions 41 of fabric 50 to create a domed structure in which the interior area of the structure gradually decreases from the bottom to the top.

The frame members 34, 38, 42, and 46 are preferably formed of flexible coilable steel, although other materials such as plastics may also be used. The frame members should be made of a material which is relatively strong and yet is flexible to a sufficient degree to allow it to be coiled. The term fabric is to be given its broadest meaning and should be made from strong, lightweight materials and may include woven fabrics, sheet fabrics or even films. The fabric should be waterproof and capable of withstanding the harsh outdoor environment to be suitable for use as an outdoor tent during camping. The fabric and frame members are preferably made of lightweight material to facilitate ease of transportation of the tent.

The tent 30 is further provided with a roof 86 which is preferably made of the same material as fabric 50. The roof 86 is located between the upper curved portions of the side panels 70, 74, 78 and 82 and takes the form of an interconnecting fabric.

A floor portion 84 which may be made from the same material as the fabric 50 is provided to interconnect the lower edges of the side panels 70, 74, 78 and 82. Ties 88 are provided at the corners of the side panels 70, 74, 78 and 82 for additionally securing the tent 30 to the ground, although it will be appreciated that such ties 88 are not necessary for holding the tent 30 upright. The area of the floor 84 is larger than the area of the roof 86 due to the vertically inclined side panels forming the domed structure.

The tent 30 is also provided with a door 90, preferably located in a side panel, for example, side panel 70, for ingress and egress. The door 90 is essentially a triangular-shaped cut-out in the side panel 70 having a portion which is made of a fly-screen 94. The door 90 has two zipper edges 98 and 102 and a hinged edge 106. Mating zipper halves are provided along each side of the edges 98 and 102 of the door 90 and the corresponding edges of the side panel 70 to releasably hold the door 90 in a sealed position when the tent 30 is being occupied and the zippers pulled up.

Ventilation of the tent 30 is achieved through the fly-screen 94 and through vents 110 and 114 disposed at the upper curved portion of side panels 74 and 82, respectively. Vents 110 and 114 have the same construction. For example, referring to FIGS. 1, 3, 4, and 5, the vent 110 has a waterproof hood 118 which is sewn along the upper curved edges of the side panel 74. The hood 118 extends outwardly from the side panel 74 in an open position. The outer periphery 120 of the hood 118 is formed by a small steel loop 122 enclosed within the outer periphery 120 which defines the semi-circular shape of the outer periphery 120. A hinged hook 126 is provided at a central portion of the outer periphery 120. A strip 130 having one end sewn to a central portion of the bottom of side panel 74 has an opposite end which may be hooked by the hinged hook 126 to keep the hood open. The upper portion of side panel 74 is made up of a mesh portion 132. The upper curved portion of the frame member 38 and an elongated steel strip 138 together define the semi-circular shape of the mesh portion 132. The outer periphery 120 of the hood 118 and the steel strip 138 define a semi-circular shape for fitting another screen mesh 134 therebetween.

Figure 5:
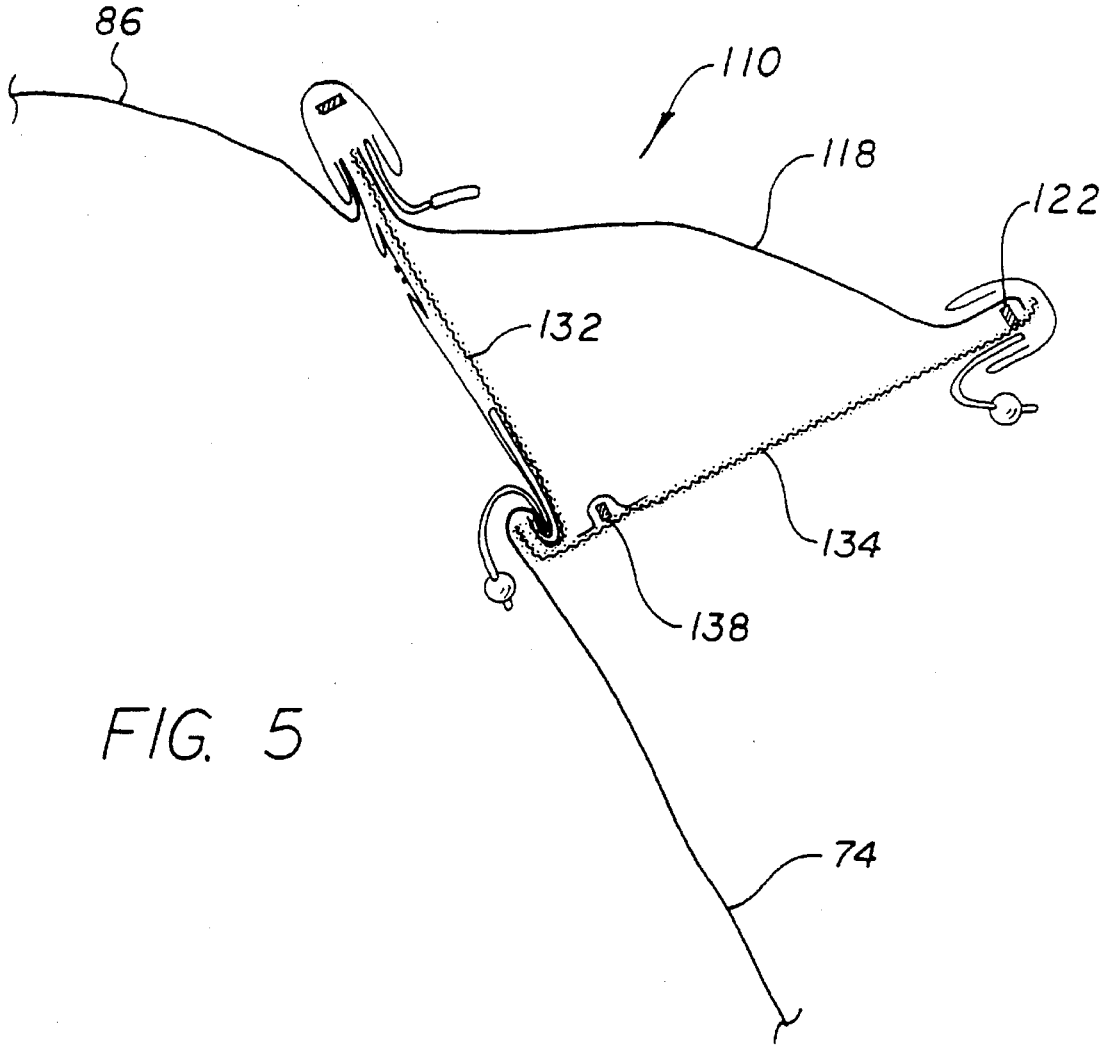
FIG. 5 is a cross-sectional side view of the vent of FIG. 3 in an open position.
Figure 4:
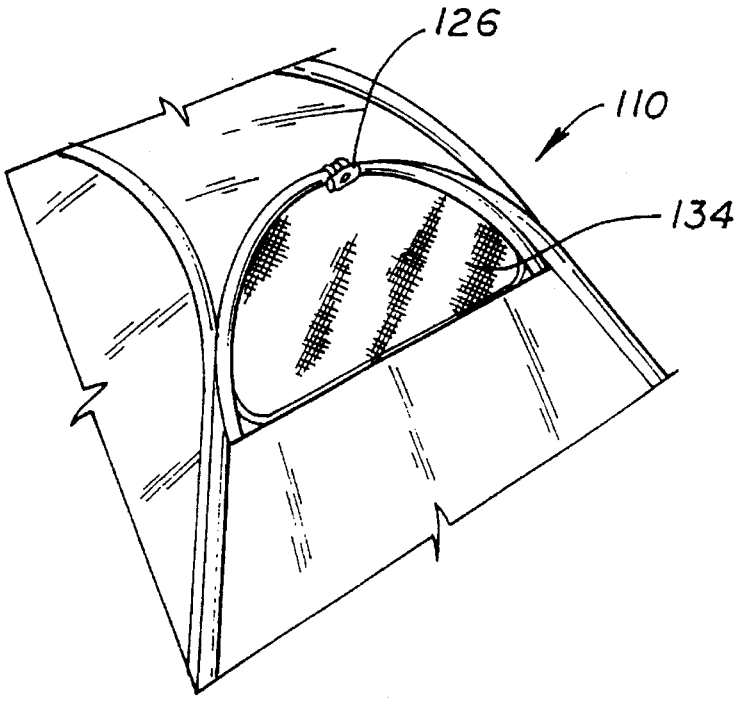
FIG. 4 is a perspective view of the vent of FIG. 3 in a closed position.

The vent 110 may be held in the open position shown in FIGS. 1, 3, and 5 by hooking the strip 130 to the hook 126. The hood 118 is retracted when the tent 30 is to be collapsed and stored. When the hood 118 is to be retracted, the strip 130 is unhooked from the hook 126, and the hood 118 is pulled upwardly so that the hinged hook 126 may be made to hook an elastic loop 142 so that the screen mesh 134 is held firmly against the mesh portion 132 of the side panel 74. Regardless of whether the hood 118 is tied in the open or in the closed position, the mesh portion 132 and the screen mesh 134 provide ventilation to the inside compartment of the tent 30, as well as shielding the interior of the tent 30 from bugs and insects.

FIG. 6 illustrates an additional modification that may be made to the tent 30 of the present invention. For example, rods 146 and 150 are provided in a manner perpendicular to each other to provide further support to the upper portion of the tent 30 and, in particular, the roof 86. Openings 154 are provided at an upper central portion of each side panel for receiving the ends of the rods 146 and 150. A retaining member 158 is fixed at the central point of the roof 86 and holds the rods 146 and 150 perpendicular to each other in such a manner that each end of the rod 146 or 150 is fitted through a guide 162 and its corresponding opening 154. This provides more stability to the roof 86 and the structure of the tent 30.

FIG. 7 illustrates a second embodiment 200 of the tent of the present invention wherein the tent 200 is provided with six inclined triangular side panels as opposed to the four triangular side panels shown in the embodiment of FIG. 1. As with the embodiment of FIG. 1, each side panel 204 is provided with a separate frame member 208 to provide the necessary stable support.

FIG. 8 illustrates a third embodiment 230 of the tent of the present invention wherein five inclined triangular side panels 234 supported by five frame members 238 are provided.

Figure 9:
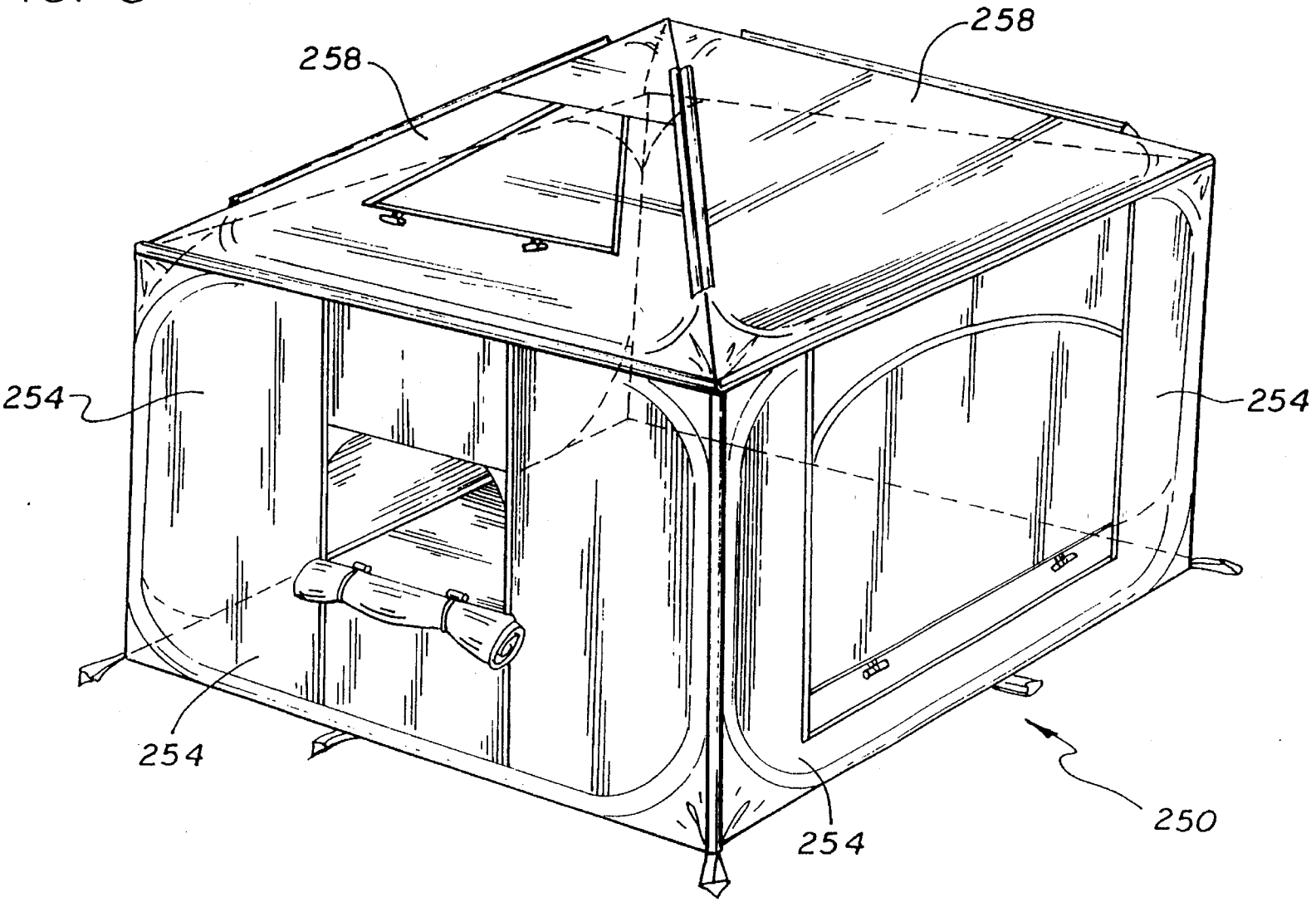
FIG. 9 is a fourth embodiment of the collapsible shade structure having four rectangular side panels and a roof comprising two triangular panels.

FIG. 9 illustrates a fourth embodiment 250 of the tent of the present invention wherein four rectangular side panels 254 are provided but are arranged to stand vertically as opposed to being inclined at an angle so as to form a rectangular internal block or space. The roof in the embodiment of FIG. 9 may be formed by two triangular-shaped-frame members 258 which may be folded one upon the other when the tent is folded and collapsed.

Figure 10:
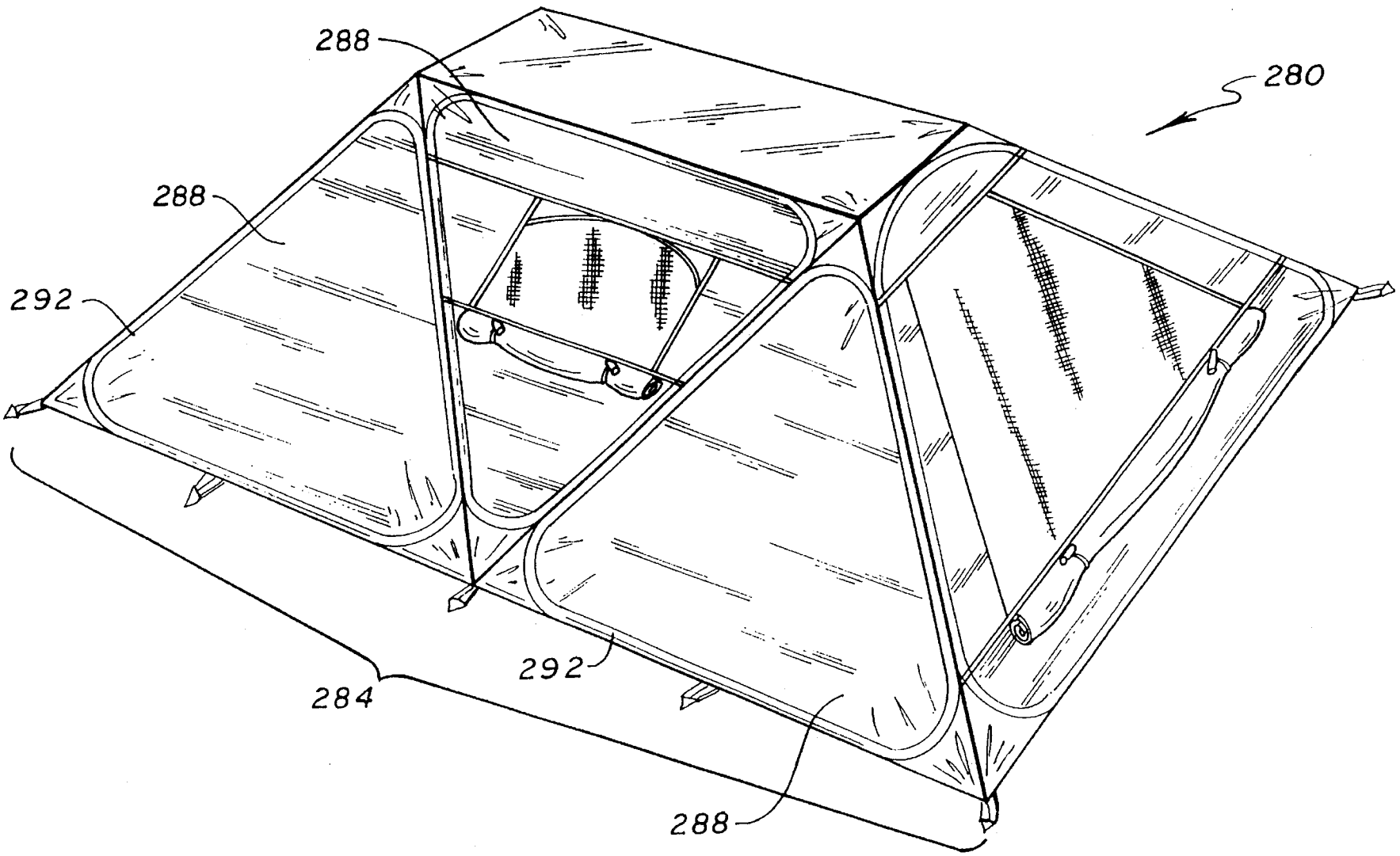
FIG. 10 is a fifth embodiment similar to the embodiment of FIG. 1, having three triangular side panels along two of the sides thereof.

FIG. 10 illustrates a fifth embodiment 280 of the tent of the present invention wherein two opposing walls 284 may be lengthened by providing three inclined side panels 288 to comprise each wall 284, each side panel 288 supported by a separate frame member 292.

It can be seen, therefore, that the tent of the present invention may take a variety of external shapes. These external shapes are facilitated by the provision of additional frame members configured to form the desired shape. Each side of the tent, regardless of the shape, is supported by at least one frame member. The tent may be of any size but is commonly of such a size as to accommodate one or more persons.

Figure 11A:
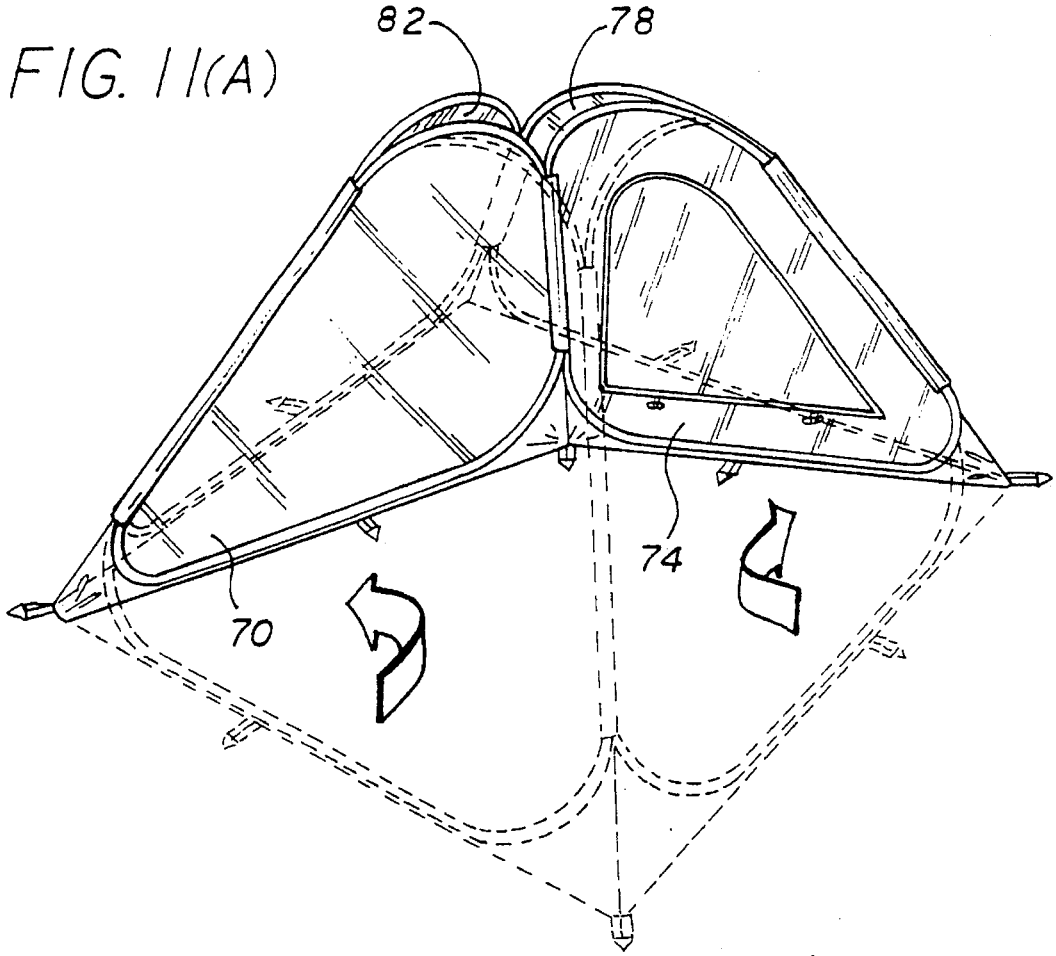
Figure 11B:
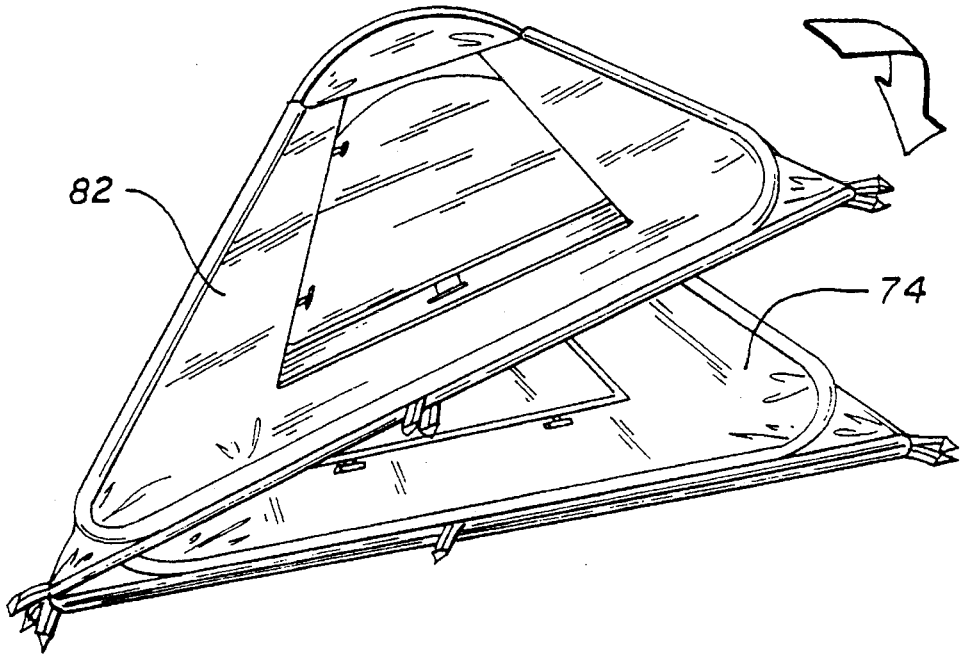
Figure 11C:
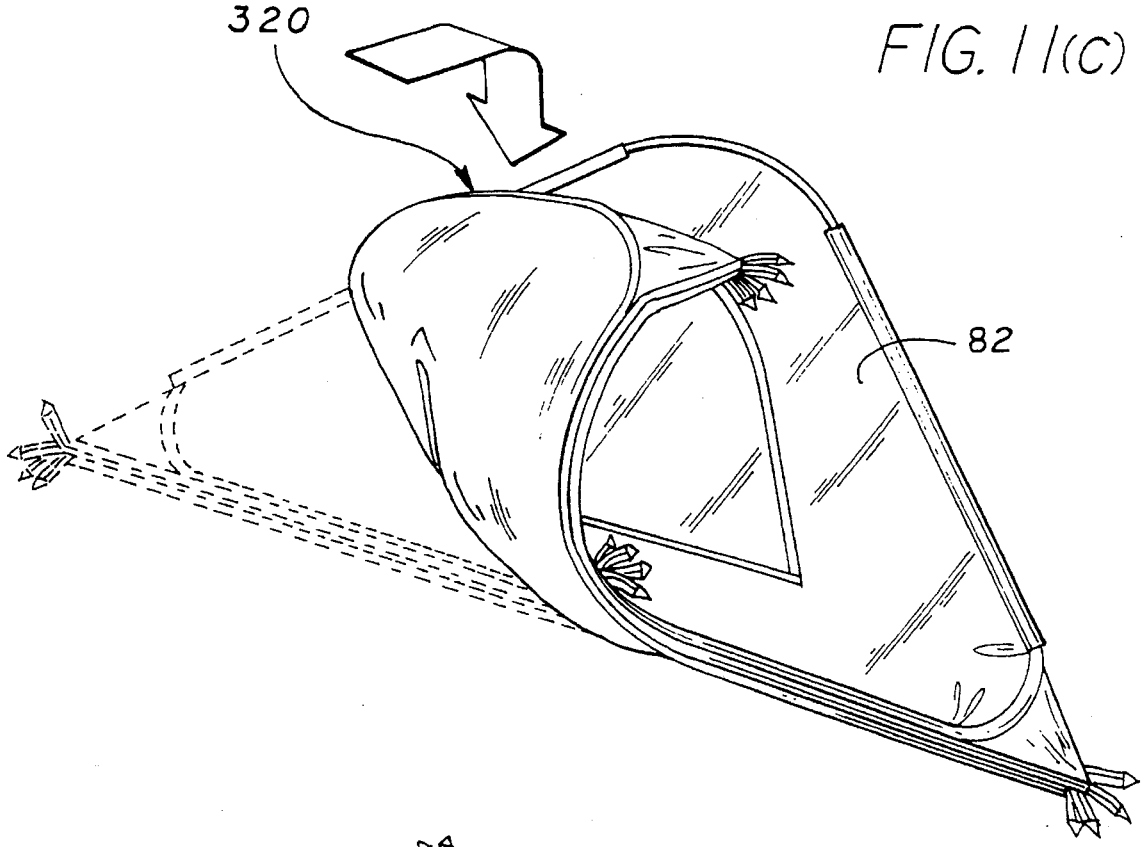
Figure 11D:
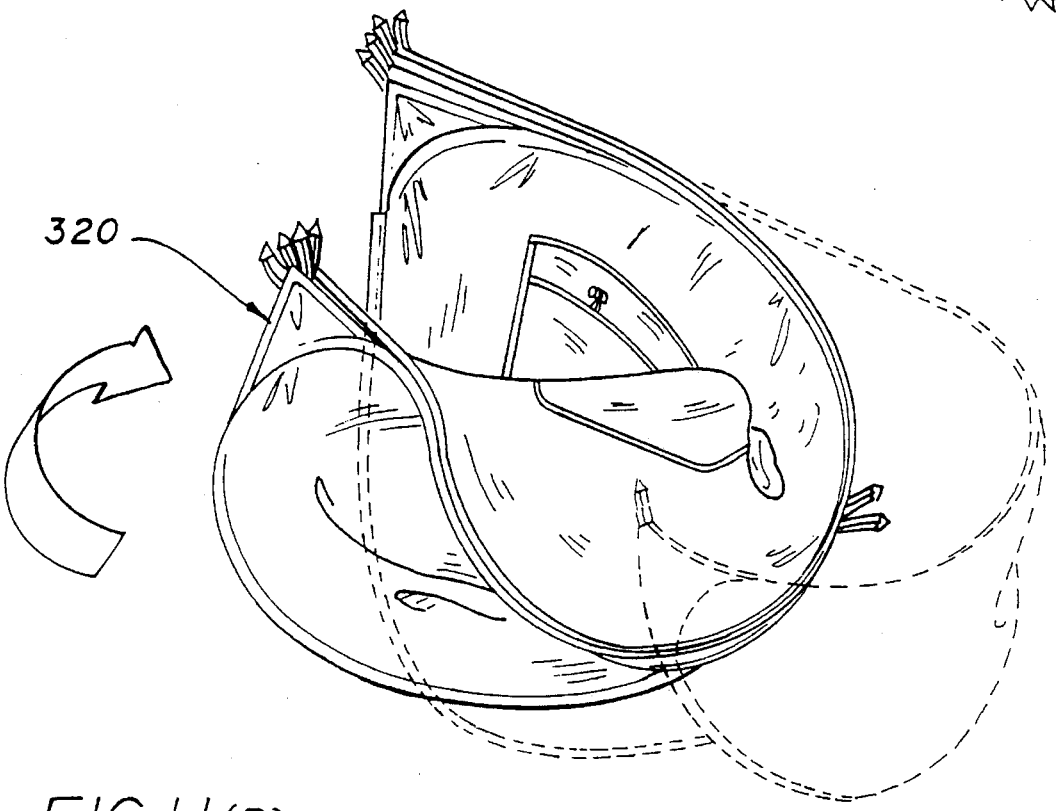

FIGS. 11(A) through 11(F) describe the various steps for folding the tent 30 of the embodiment of FIGS. 1–5 for storage. In FIG. 11(A), the first step consists of pushing in side panels 70 and 74 such that side panel 70 collapses upon side panel 82 and side panel 74 collapses upon side panel 78. Then, in the second step shown in FIG. 11(B), the two side panels 70 and 82 are folded so as to be collapsed upon the two side panels 74 and 78. The structure is twisted and folded to collapse the frame members and side panels into a smaller shape. In the third step shown in FIGS. 11(C) and 11(D), the opposite border 320 of the structure is folded in upon the previous fold to further collapse the frame members with the side panels. As shown in FIG. 11(E), the fourth step is to continue the collapsing so that the initial size of the structure is reduced. FIG. 11(F) shows the fifth step with the frame members and side panels collapsed on each other to provide for a small essentially compact configuration having a plurality of concentric frame members and layers of the side panels so that the collapsed structure has a size which is a fraction of the size of the initial structure.

Figure 12:
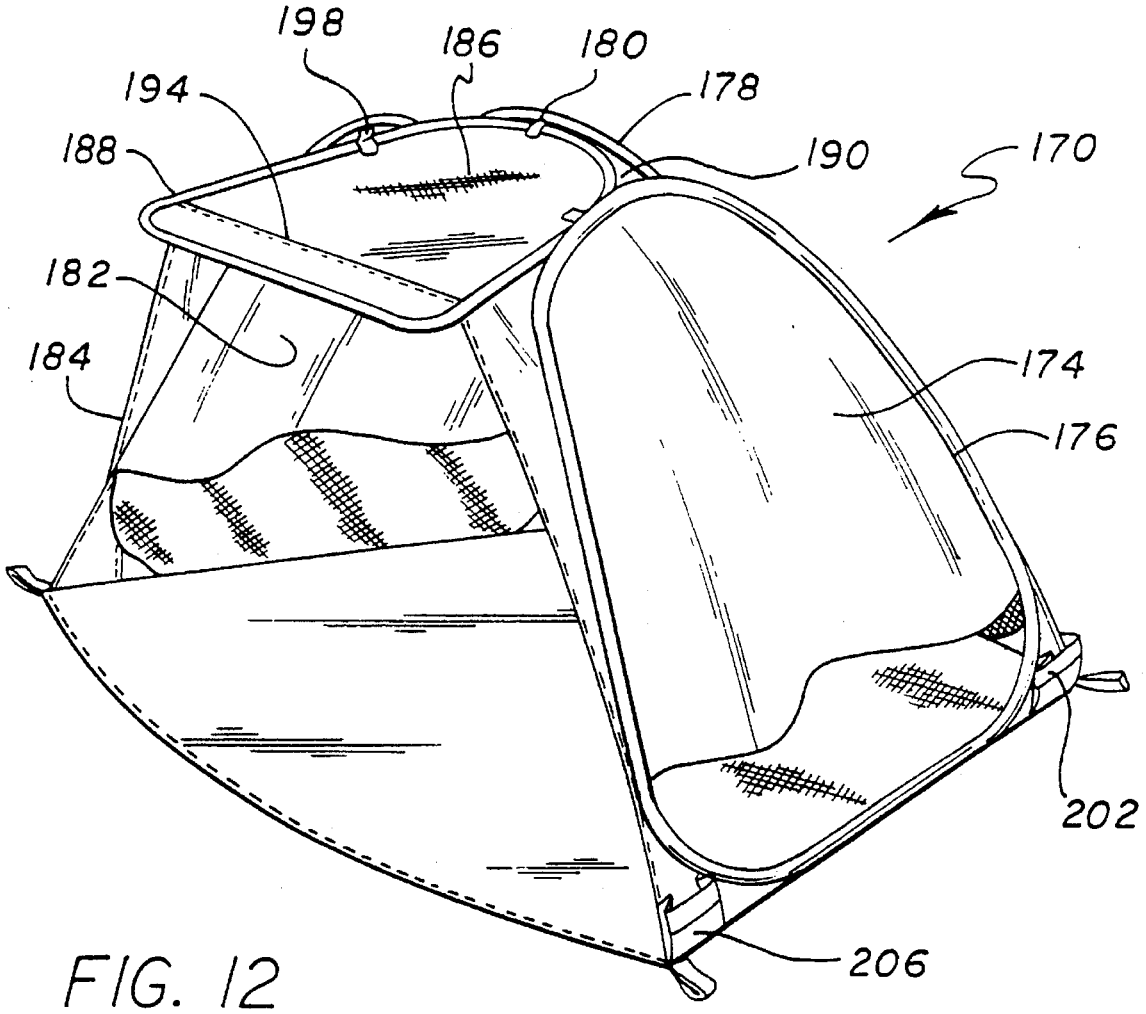
FIG. 12 is a perspective view of a sixth embodiment of the collapsible shade structure which may be used as a cabana, showing a side panel acting as a door in an open position exposing the interior of the cabana.
Figure 13:
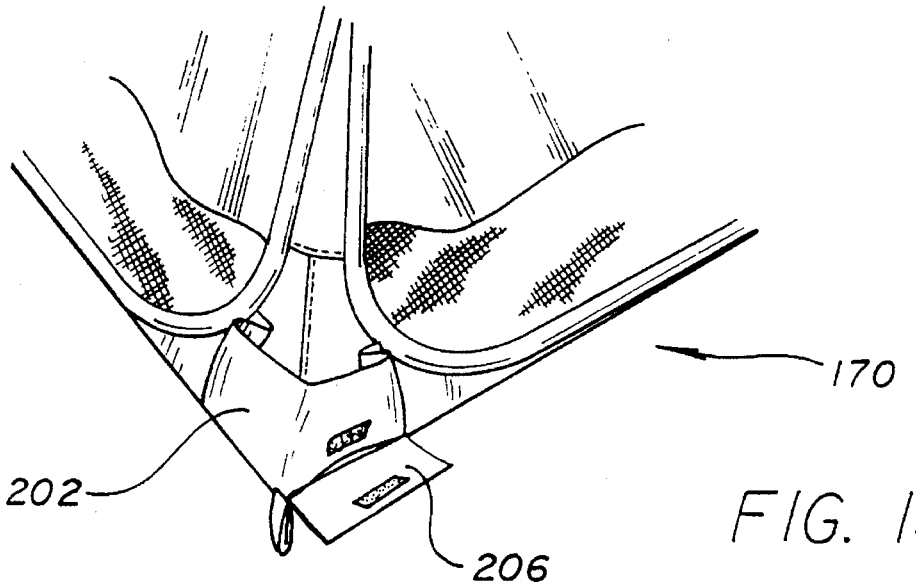
FIG. 13 is a perspective view of one of the corners of the cabana of FIG. 12.

Referring to FIG. 12, the collapsible shade structure of the present invention may take the form of a cabana 170. The cabana 170 is comprised of three side panels 174, 178 and 182, each supported by a frame member, 176, 180 and 184, respectively. The cabana 170 also has a mesh door 186 which is also supported by a frame member 188. The mesh door 186 is sewn to the roof 190 along a hinged edge 194 so that the mesh door may be flipped up or down about the hinged edge 194. The mesh door 186 may be flipped to an open position such as that shown in FIG. 12 and held in place atop the roof 190 by means of "Velcro" pads 198. As shown in FIG. 13, the four corners of the cabana may be provided with pockets 202 which are used to collect sand. Each pocket 202 is provided with a flap 206, which is normally secured to the pocket 202 by means of "Velcro" pads, but the flap 206 may be opened to allow the sand collected therein to be emptied.

Figures 14A, 15:
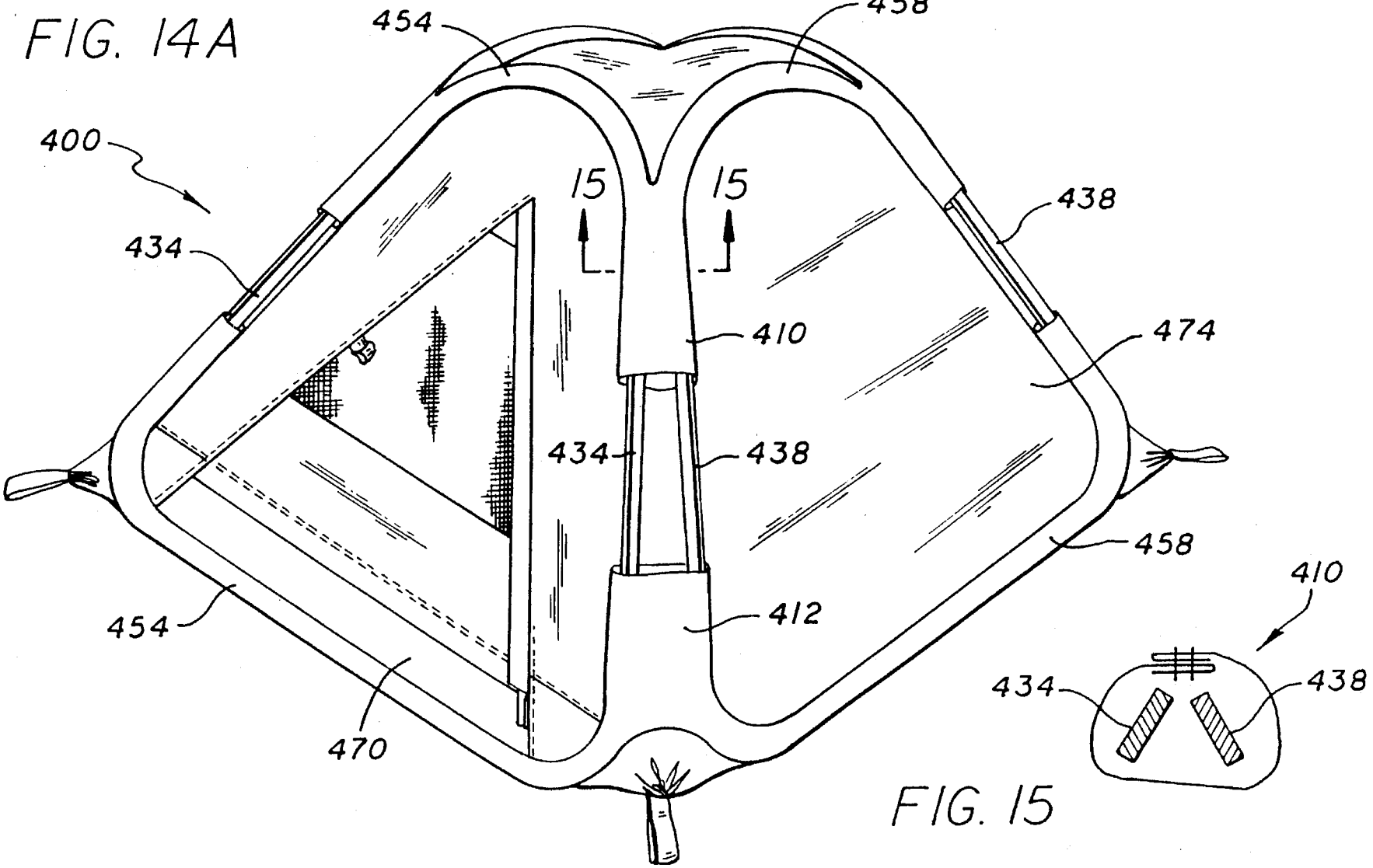
FIGS. 14A–14C are perspective views of a seventh embodiment and modifications thereto in which one retaining sleeve is used to hold two frame members of adjacent side panels.
FIG. 15 is a cross-sectional view of a retaining sleeve and frame members taken along lines 15—15 of FIG. 14A.
Figure 14B:
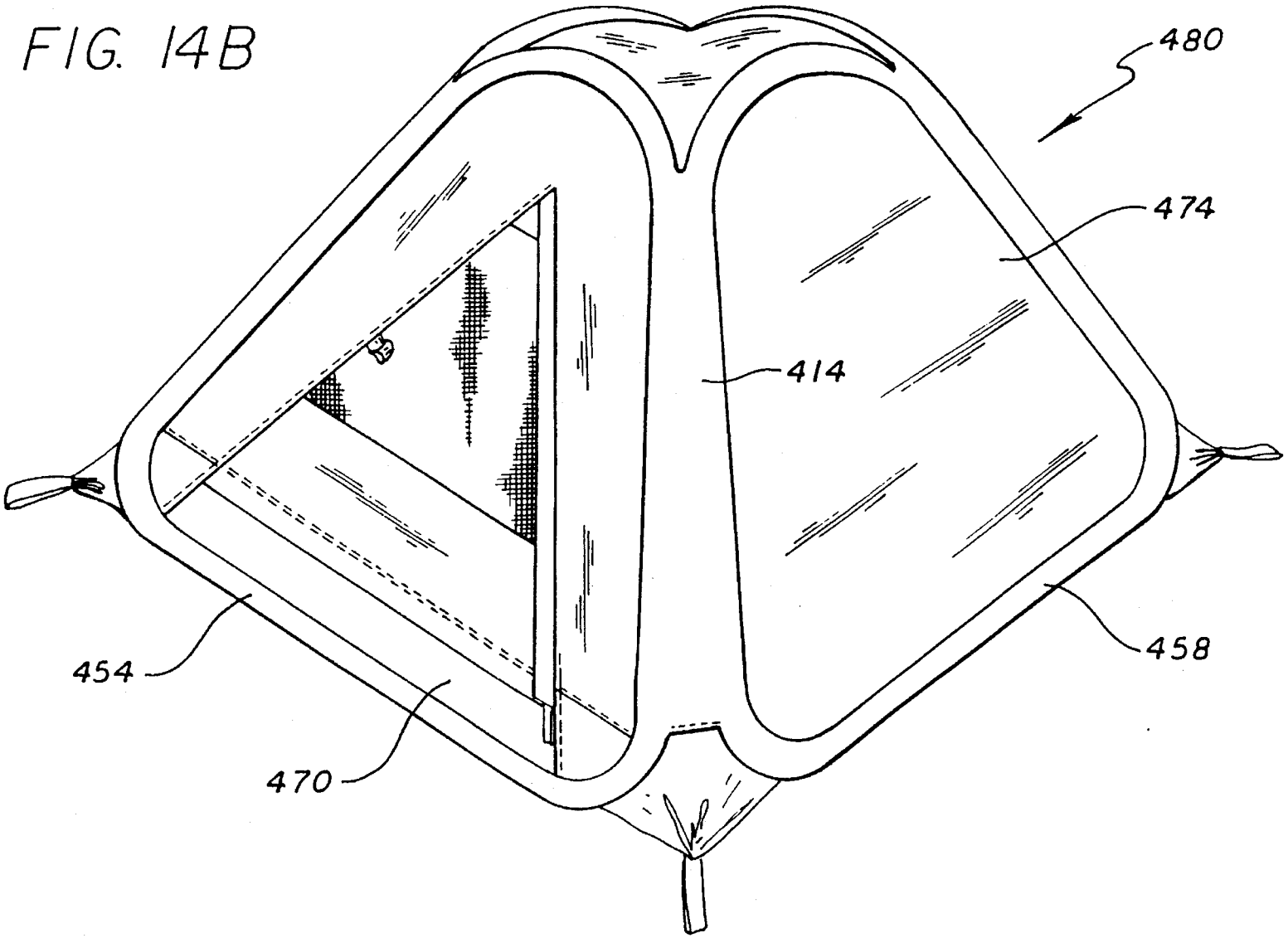
Figure 14C:
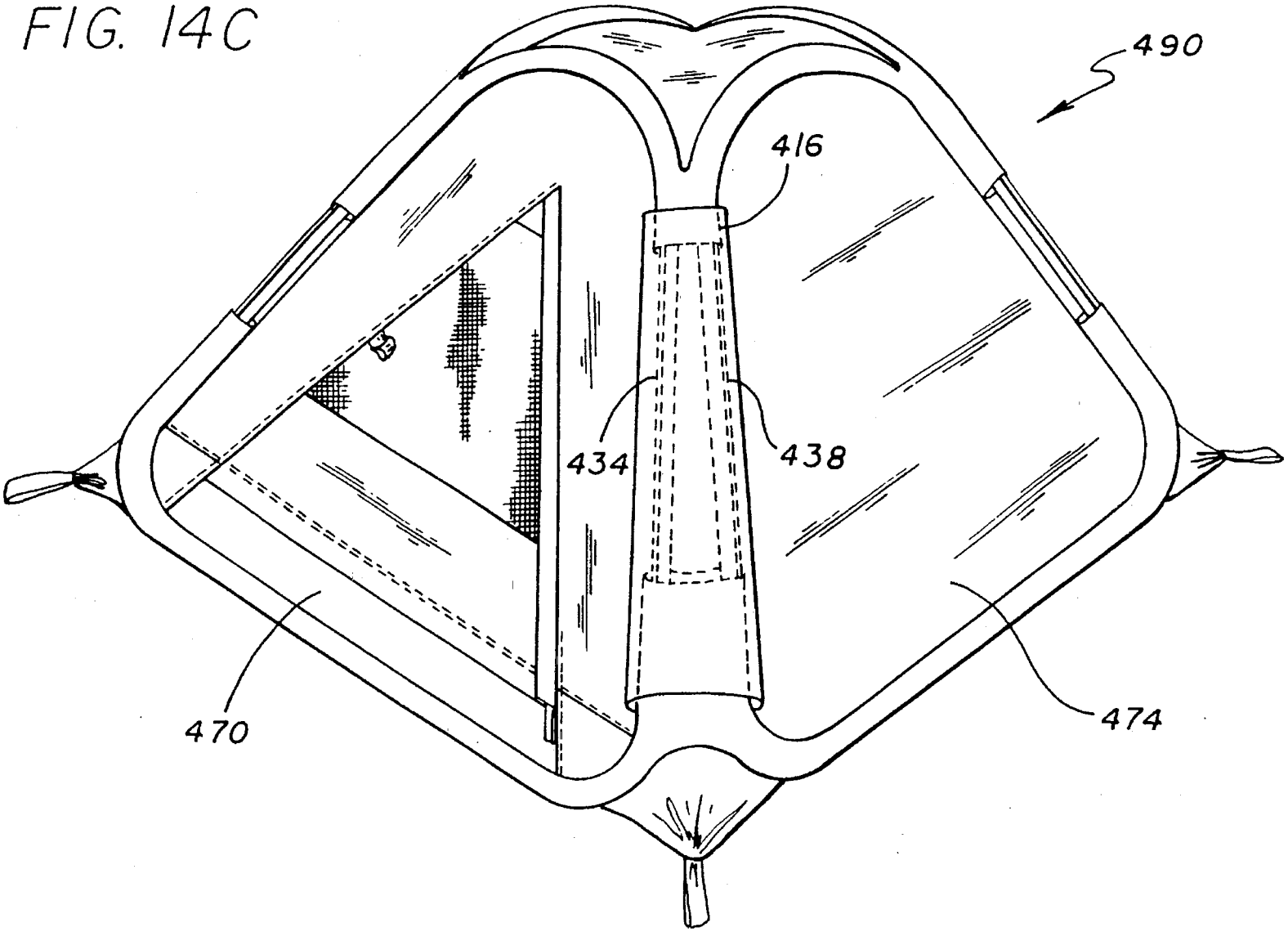

FIGS. 14A–14C illustrate a seventh embodiment 400 in which the embodiment of FIG. 1 has been modified so that the portions of the retaining sleeves between each adjacent side panel retain the adjacent frame members and also act as interconnecting hinge portions. Referring specifically to FIG. 14A, the retaining sleeves 454 and 458 converge at sleeve portions 410 and 412 interconnecting side panels 470 and 474 to form one retaining sleeve which both retains the frame members 434 and 438, and acts as a hinge for the side panels 470 and 474. The frame members 434 and 438 are exposed at the central portion between sleeve portions 410 and 412.

Embodiment 480 of FIG. 14B is a modification of embodiment 400 of FIG. 14A in which retaining sleeves 454 and 458 converge between side panels 470 and 474 to form sleeve portion 414 which entirely covers the frame members 434 and 438, as well as acting as an interconnecting hinge portion. Embodiment 490 of FIG. 14C is yet another modification of embodiment 400 of FIG. 14A in which an outside retaining sleeve 416 is provided about the exposed portions of frame members 434 and 438 to cover the frame members 434 and 438. The outside retaining sleeve 416 also acts as interconnecting hinge portion between side panels 470 and 474.

As illustrated in FIG. 15, both frame members 434 and 438 are retained within one retaining sleeve portion 410. The other side panels are likewise hinged with their frame members retained at the hinged portions by one retaining sleeve portion. The use of one retaining sleeve portion to retain adjacent frame members and to hinge two adjacent side panels may also be applied to each of the above-described embodiments of FIGS. 7–10 and 12–13. This singular retaining sleeve eliminates the need for interconnecting fabric material to act as a hinge portion, thereby making the collapsible structure easier and less expensive to manufacture, and making it easier to fold one side panel and its frame member on top of an adjacent side panel and its frame member.

Figures 16, 17:
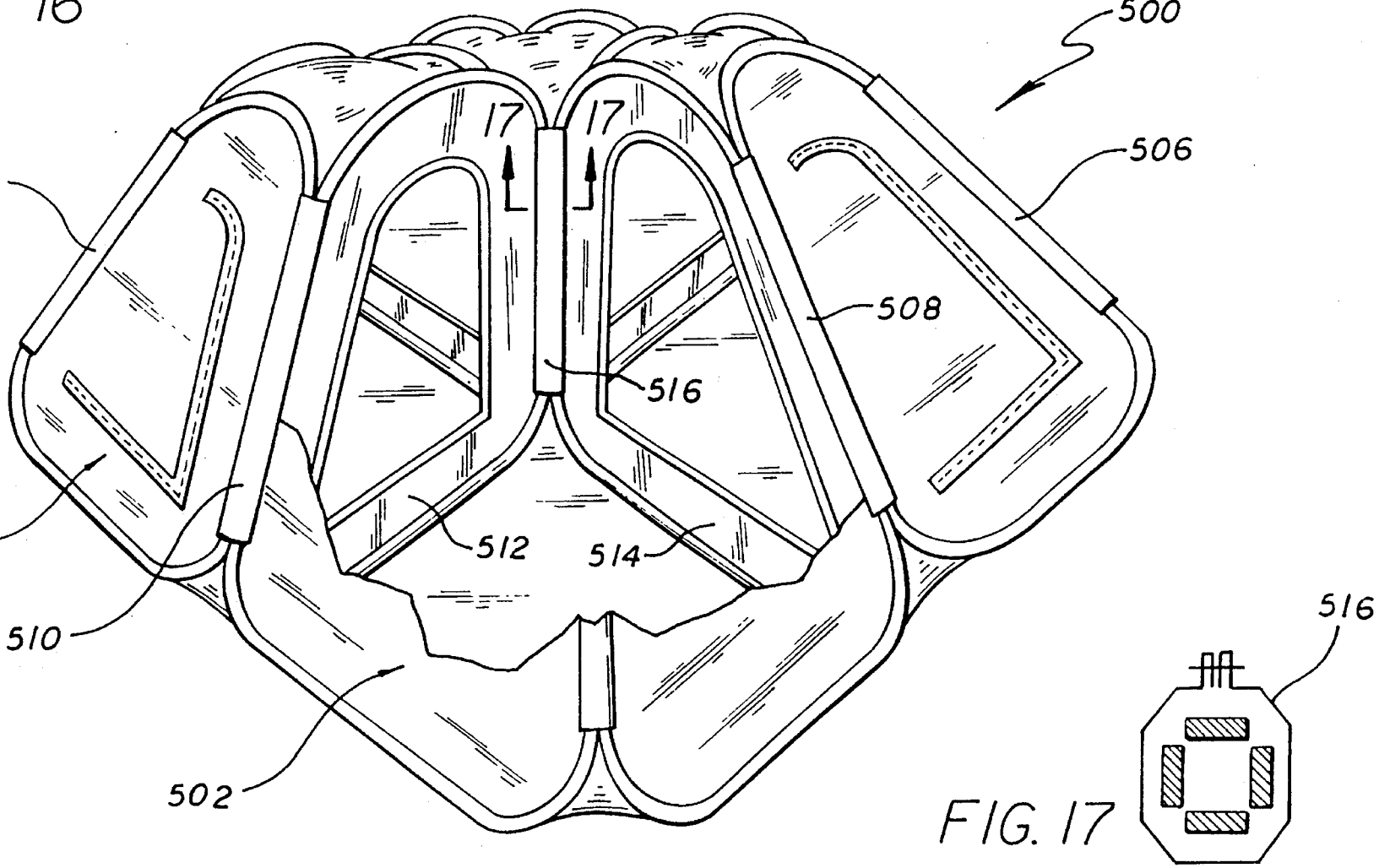
FIG. 16 is a perspective view of an eighth embodiment in which a plurality of the collapsible structures of FIG. 14 are combined to form a large structure having a plurality of defined "rooms" or compartments.
FIG. 17 is a cross-sectional view of a retaining sleeve and frame members taken along lines 17—17 of FIG. 16.

The use of one retaining sleeve portion to retain adjacent frame members and to act as an interconnecting hinge portion for two adjacent side panels is especially beneficial when used to combine a plurality of collapsible structures to form a large structure having a plurality of separate compartments or "rooms". Referring to FIGS. 16 and 17, an eighth embodiment 500 is comprised of a plurality of separate collapsible structures 502, each having four side panels hinged to adjacent side panels by retaining sleeves in any of the manners described in FIGS. 14A–14C above. Some of the side panels, such as 512 and 514, for example, act as walls to form separate compartments within the structure 500. The separate compartments are actually defined by each separate structure 502. Some retaining sleeves, such as 504 and 506 for example, may be used to retain two frame members, while other retaining members, such as 508 and 510, for example, may retain up to three frame members and retaining member 508 may return four frame members (see FIG. 17). For a very large structure 500, the different compartments could be used as "rooms", each serving a different purpose, such as a dining room, a living room, a play room, a guest room, a bedroom, or a sun room (if the side panel is entirely meshed to allow sunlight to radiate therethrough).

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible shade structure supported on a surface for defining and enclosing an interior space, the shade structure comprising:

at least three foldable frame members each having a folded and an unfolded orientation, each frame member comprising three sides forming a continuous loop in the unfolded orientation;

a fabric material substantially covering the frame members to form a side panel for each frame member, each side panel assuming the unfolded orientation of its associated frame member;

each frame member and its associated side panel having a first side connected to an adjacent frame member and its associated side panel by first interconnecting hinge means and a second side connected to another adjacent frame member and its associated side panel by second interconnecting hinge means; and the frame members and their associated side panels held together to form an enclosed interior space with a third side of each frame member resting on the surface to support the shade structure;

wherein the first and second sides of each frame member have an upper end and a lower end, and the third side of each frame member has opposing ends, with the upper ends of the first and second sides coupled to each other, and with each of the lower ends of the first and second sides coupled to one of the opposing ends of the third side.

2. The collapsible shade structure of claim 1 wherein each hinge means retains the adjacent sides of the adjacent frame members.

3. The collapsible shade structure of claim 2 wherein each hinge means comprises upper and lower sleeve retaining portions, each sleeve retaining portion retaining the adjacent sides of the adjacent frame members.

4. The collapsible shade structure of claim 2 wherein each hinge means comprises a sleeve retaining portion retaining the adjacent sides of the adjacent frame members.

5. The collapsible shade structure of claim 2 wherein the fabric material is provided with frame retaining sleeves for retaining a portion of the frame members.

6. The collapsible shade structure of claim 1 wherein each frame member has a triangular configuration.

7. The collapsible shade structure of claim 1 further including a floor portion interconnecting lower portions of the side panels.

8. The collapsible shade structure of claim 1 further including at least one vent for providing ventilation to the interior of the structure.

9. A collapsible shade structure supported on a surface for defining and enclosing an interior space, the shade structure comprising:

at least three foldable frame members each having a folded and an unfolded orientation, each frame member comprising three sides forming a continuous loop in the unfolded orientation;

a fabric material substantially covering the frame members to form a side panel for each frame member, each side panel assuming the unfolded orientation of its associated frame member;

each frame member and its associated side panel having a first side hingedly connected to an adjacent frame member and its associated side panel and a second side hingedly connected to another adjacent frame member and its associated side panel; and the frame members and their associated side panels held together to form an enclosed interior space with a third side of each frame member resting on the surface to support the shade structure;

wherein the first and second sides of each frame member have an upper end and a lower end, and the third side of each frame member has opposing ends, with the upper ends of the first and second sides coupled to each other, and with each of the lower ends of the first and second sides coupled to one of the opposing ends of the third side.

10. The collapsible shade structure of claim 9 further comprising upper and lower sleeve retaining portions, each sleeve retaining portion retaining the adjacent sides of the adjacent frame members.

11. The collapsible shade structure of claim 9 further comprising a sleeve retaining portion retaining the adjacent sides of the adjacent frame members.

12. The collapsible shade structure of claim 9 wherein the fabric material is provided with frame retaining sleeves for retaining a portion of the frame members.

13. The collapsible shade structure of claim 9 wherein each frame member has a triangular configuration.

14. The collapsible shade structure of claim 9 further including a floor portion interconnecting lower portions of the side panels.

15. The collapsible shade structure of claim 9 further including at least one vent for providing ventilation to the interior of the structure.

* * * * *